US005797787A

United States Patent [19]

Kaye

[11] Patent Number: 5,797,787

[45] Date of Patent: Aug. 25, 1998

[54] FULL-FIGURED WOMAN'S GARMENT

[76] Inventor: Shelly Kaye, 165 Lindbergh Ave., Oceanside, N.Y. 11572

[21] Appl. No.: 891,712

[22] Filed: Jul. 11, 1997

[51] Int. Cl.[6] ..... A41C 3/00; A41C 3/12

[52] U.S. Cl. ..... 450/30; 450/31; 450/32; 450/58; 2/73

[58] Field of Search ..... 2/73, 104, 118, 2/105, 113, 106, 115, 109, 110; 450/30, 31, 32, 58, 53, 54, 55, 56, 60, 61, 62, 92, 93

[56] References Cited

U.S. PATENT DOCUMENTS

| | | | |
|---|---|---|---|
| 865,785 | 9/1907 | Lavy | 2/110 |
| 933,265 | 9/1909 | Reid | 2/109 |
| 1,057,798 | 4/1913 | Benjamin | 2/115 |
| 1,363,038 | 12/1920 | Gottlieb | 2/110 |
| 1,657,092 | 1/1928 | Oathout | 2/115 |
| 2,683,879 | 7/1954 | Dollarehide | 450/78 |
| 4,412,542 | 11/1983 | Reichert | 450/31 |
| 4,854,915 | 8/1989 | Luedy | 450/31 |

*Primary Examiner*—Jeanette E. Chapman
*Attorney, Agent, or Firm*—Kirschstein et al.

[57] ABSTRACT

A woman's garment effectively restrains uncontrolled movement of one or both breast implants, natural breasts, or breast prostheses, without any external readily visible means of support by pulling taut a pair of drawstrings that effectively draws one or both pockets for receiving the implants, natural breasts, or prostheses tightly against the wearer's chest.

20 Claims, 4 Drawing Sheets

FIG. 1
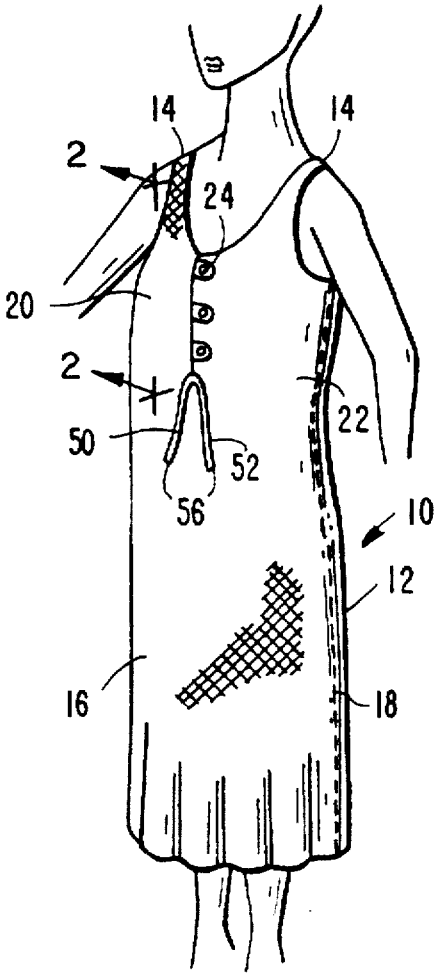
FIG. 2
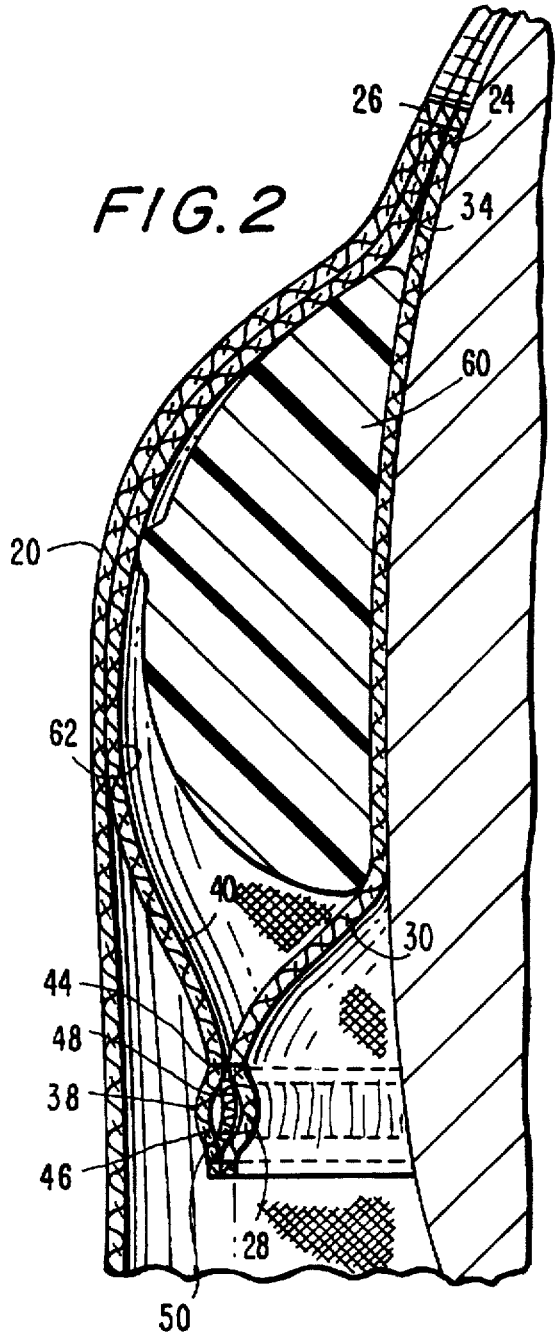
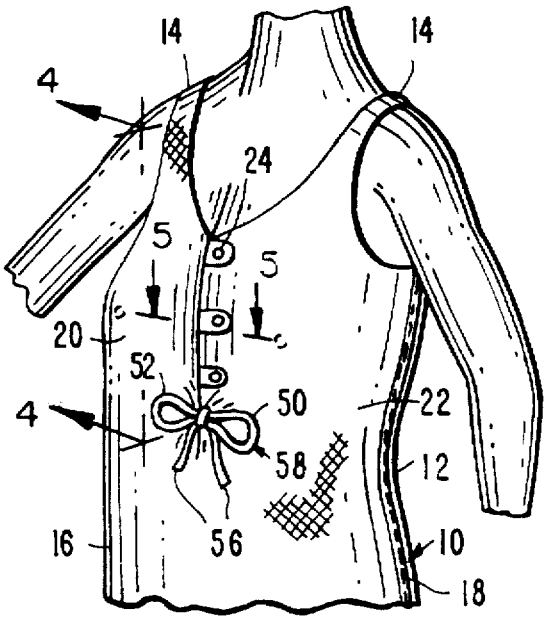
FIG. 3

FIG. 4
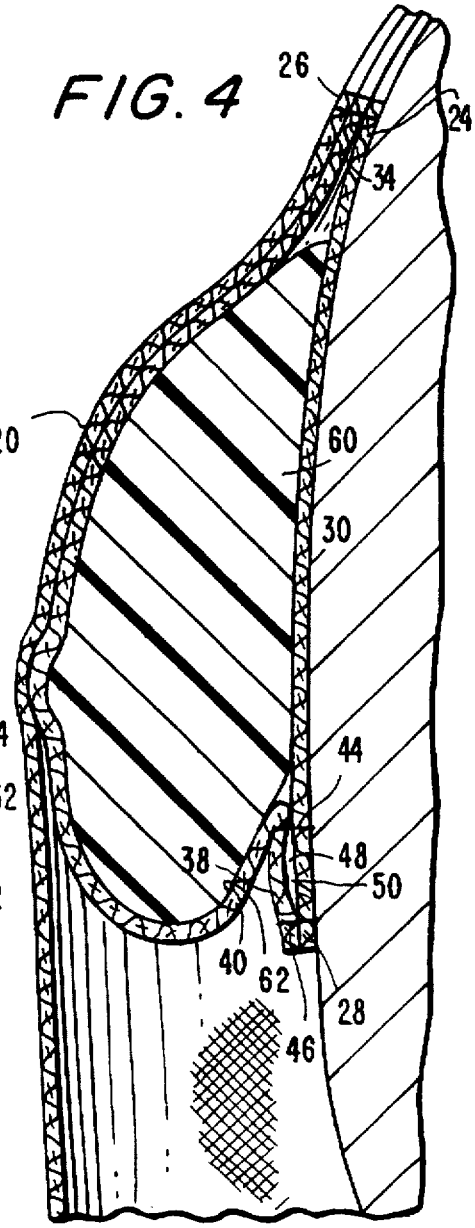
FIG. 5
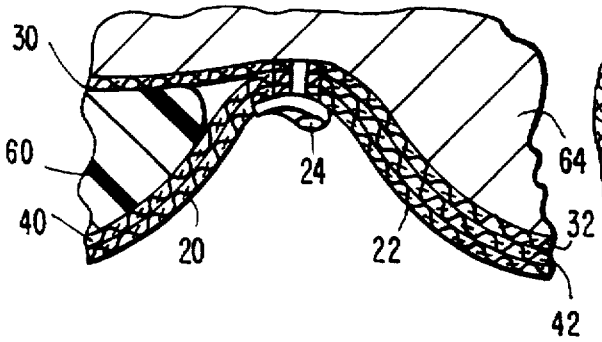
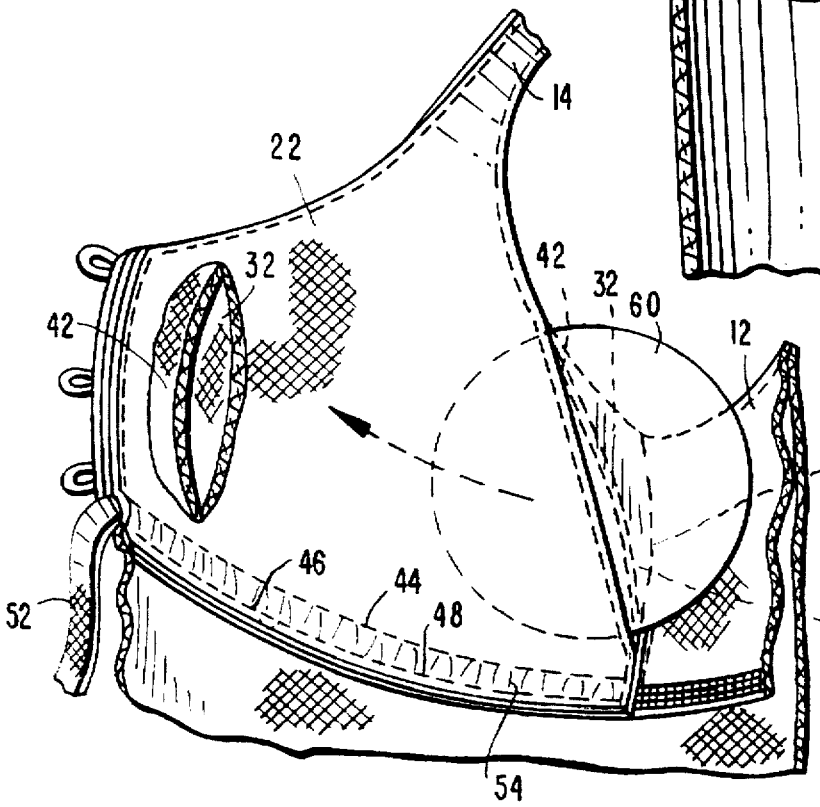
FIG. 6

FIG. 7
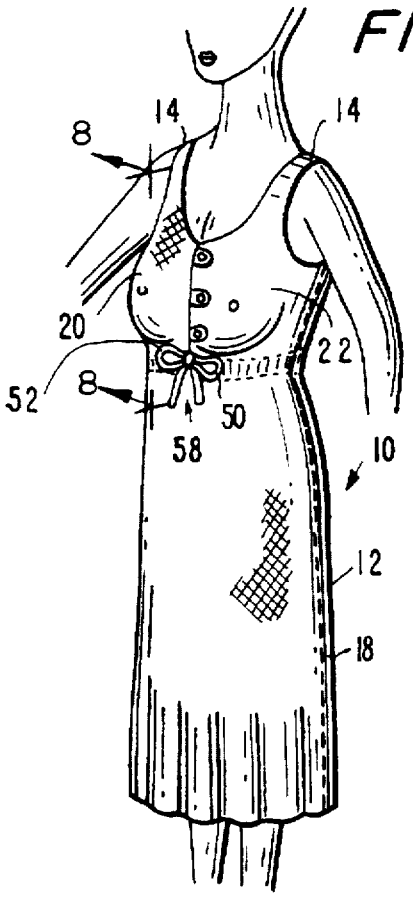
FIG8
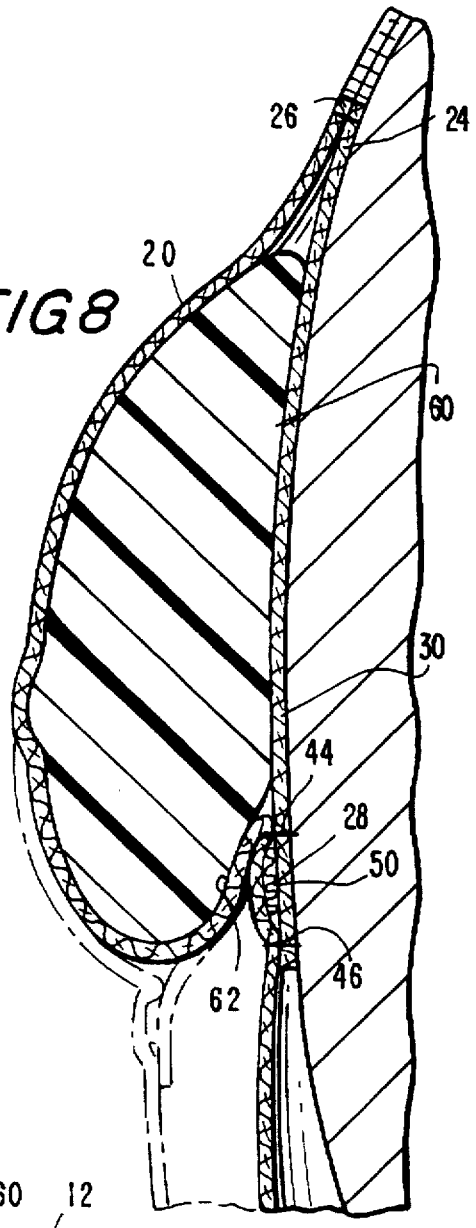
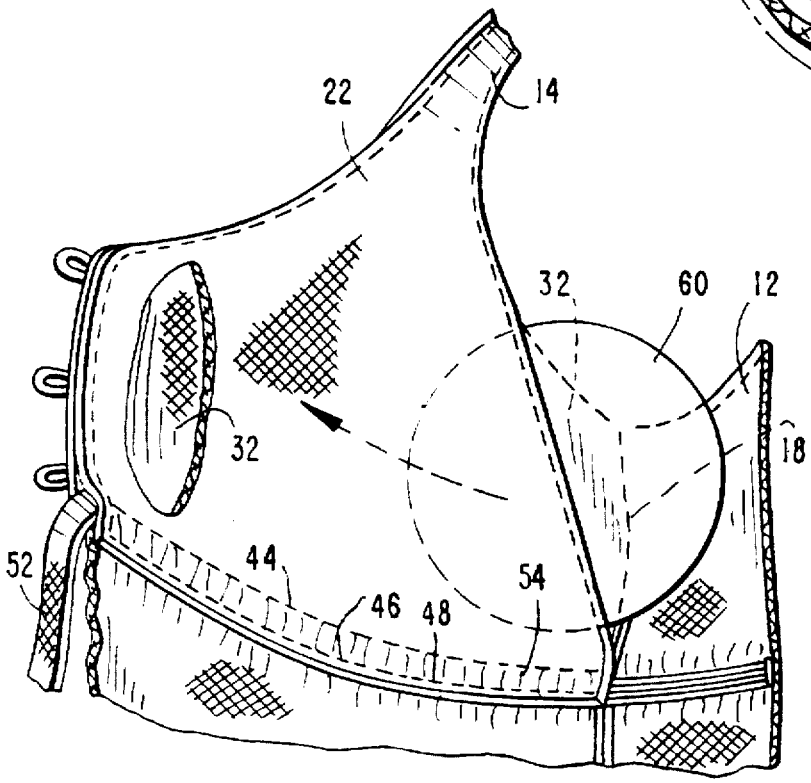
FIG. 9

FULL-FIGURED WOMAN'S GARMENT

BACKGROUND OF THE INVENTION

1. Field of the Invention

The present invention relates to a woman's garment and, more particularly, to clothing for wear by women who are relatively large-breasted, or who have either had a mastectomy, or a breast implant operation.

2. Description of the Related Art

Aside from the psychological and physical trauma associated with the removal of one or both human breasts as a result of a mastectomy, there exists the practical problem of having a garment fit correctly. A breast prosthesis for each removed breast is usually supportably held in a brassiere worn underneath a dress, blouse or like public attire, thereby effectively simulating each removed breast and making the garment fit as expected.

Private attire, such as a nightgown worn to bed or a frock worn in the privacy of one's home, can, of course, be worn with such a prosthesis-held bra. However, the prosthesis is often different in weight than a natural breast, and the bra itself is a confining garment, thereby making the wearer uncomfortable under circumstances where comfort is desired.

To alleviate such discomfort, nightgowns with built-in pockets for receiving breast prostheses have been proposed. However, in use, the prostheses tend to uncontrollably sway from side-to-side and up-and-down as the wearer moves. It is not uncommon for a wearer lying on her back in bed to have the breast prostheses move apart from each other and unnaturally hang from opposite sides of her body. When only one prosthesis is present, that prosthesis moves differently than the other natural breast, thereby causing discomfort and embarrassment.

All these problems are magnified in the case of a naturally large-breasted woman, where the prosthesis is correspondingly larger in size. Also, in the case where no mastectomy has been performed, the naturally large-breasted woman wearing a conventional nightgown often feels uncomfortable as her natural breasts sway without being confined by a bra or like support garment. In addition, a woman having had artificial breast implants, especially those of large size, may wish to control the relatively great swaying movement of her implants without being compelled to wear a bra to bed.

OBJECTS OF THE INVENTION

Accordingly, it is a general object of this invention to provide a garment that can supportably hold and controllably restrain undue movement of one or two natural breasts, artificial breast implants, and breast prostheses.

More particularly, it is an object of the present invention to provide a nightgown, frock or like private attire that can control undue large swaying movements of natural breasts, artificial breast implants, and breast prostheses.

Still another object of the present invention is to provide a garment, especially for women having had a mastectomy, which is comfortable to wear in a private setting.

It is yet another object of the present invention to reduce the physical and psychological discomfort associated with a mastectomy.

A still further object of the present invention is to provide an all-purpose support garment especially beneficial to large-breasted women.

An additional object of the present invention is to provide a garment having an independently adjustable fit for each natural breast, implant and prosthesis.

A concomitant object of the present invention is so to construct the garment of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a garment, especially but not necessarily, a nightgown or like private attire, comprising a rear garment portion and a front garment portion connected thereto, preferably by sewing. Each garment portion is preferably constituted of a relatively thin fabric sheet material, for example, silk, cotton, polyester, etc. The rear portion generally overlies at least part of the wearer's back, while the front portion generally overlies at least part of the wearer's chest when worn.

At least one backing underlies the front garment portion at one side of the wearer's chest. Typically, two backings are provided, one at each side. Either or both backings can be used as necessary. Each backing can be constituted of the same, or a different, material as the garment portions.

Each backing forms a pocket for receiving a breast, such as a prosthesis. Each pocket can be formed by a respective backing sewn to the front garment portion at a respective side thereof. Alternatively, a liner is provided at each side between the backing and the front garment portion, in which case each pocket is formed by sewing the liner to the backing.

An upper region of the backing and, if the liner is present, an upper region of the liner is sewn to the front garment portion above the received prosthesis. Each backing and liner, if present, has a lower region situated below the received prosthesis. Each lower region preferably has a channel extending laterally across the wearer's chest.

In accordance with this invention, at least one drawstring, and preferably two drawstrings, extend along each lower region, preferably being slidably mounted in a respective channel. Each drawstring has one anchored end connected to one of the garment portions, typically the rear garment portion, or connected to a stretch band that encircles the back of the wearer. Each drawstring has an opposite accessible end region accessibly located relative to the front garment portion. Each drawstring has an intermediate portion slidable in a respective channel and concealed from external view. Each drawstring passes from its concealed channel behind the front garment portion preferably to the front thereof through individual apertures, or a common opening or slit centrally located on the front garment portion.

In a preferred embodiment, the drawstrings are pulled taut and tied in a bow knot in front of the front garment portion. The taut drawstrings anchor each pocket and the prosthesis therein in place on the wearer's chest. Each prosthesis, thus held in position, is resisted from performing uncontrolled swaying movements. There is no confining bra. The wearer is much more comfortable in wearing such nightwear as compared to the known nightwear.

As previously mentioned, the channel is concealed from external view. This is a big factor in avoiding embarrassment on the wearer's part, since another looking at the nightgown being worn according to this invention cannot discern, by appearance alone, that a prosthesis is being worn and, of course, the minimization of unnatural breast movements reinforces the simulation that natural breasts are present.

Of course, the pockets of this invention need not be used to receive prostheses. One or both of the wearer's natural breasts or artificial implants will lie against the backing and liner, if present, but still be restricted in its swaying movement by the restraining force of the taut drawstrings. Each backing and liner lie in mutual surface engagement and form a pocket or cup for receiving the natural breast or implant.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of one embodiment of a nightgown according to this invention, prior to tautening the drawstrings;

FIG. 2 is an enlarged sectional view taken on line 2—2 of FIG. 1;

FIG. 3 is a view analogous to FIG. 1, but after the drawstrings have been tied into a knot;

FIG. 4 is an enlarged sectional view taken on line 4—4 of FIG. 3;

FIG. 5 is an enlarged sectional view taken on line 5—5 of FIG. 3;

FIG. 6 is a broken-away, perspective view of one side of the embodiment of FIG. 1 showing a breast prosthesis being inserted;

FIG. 7 is a view analogous to FIG. 3, but of a second embodiment according to this invention;

FIG. 8 is an enlarged sectional view taken on line 8—8 of FIG. 7;

FIG. 9 is a view analogous to FIG. 6, but of the second embodiment of FIG. 7.

DETAILED DESCRIPTION OF THE PREFERRED EMBODIMENTS

Figure 10:
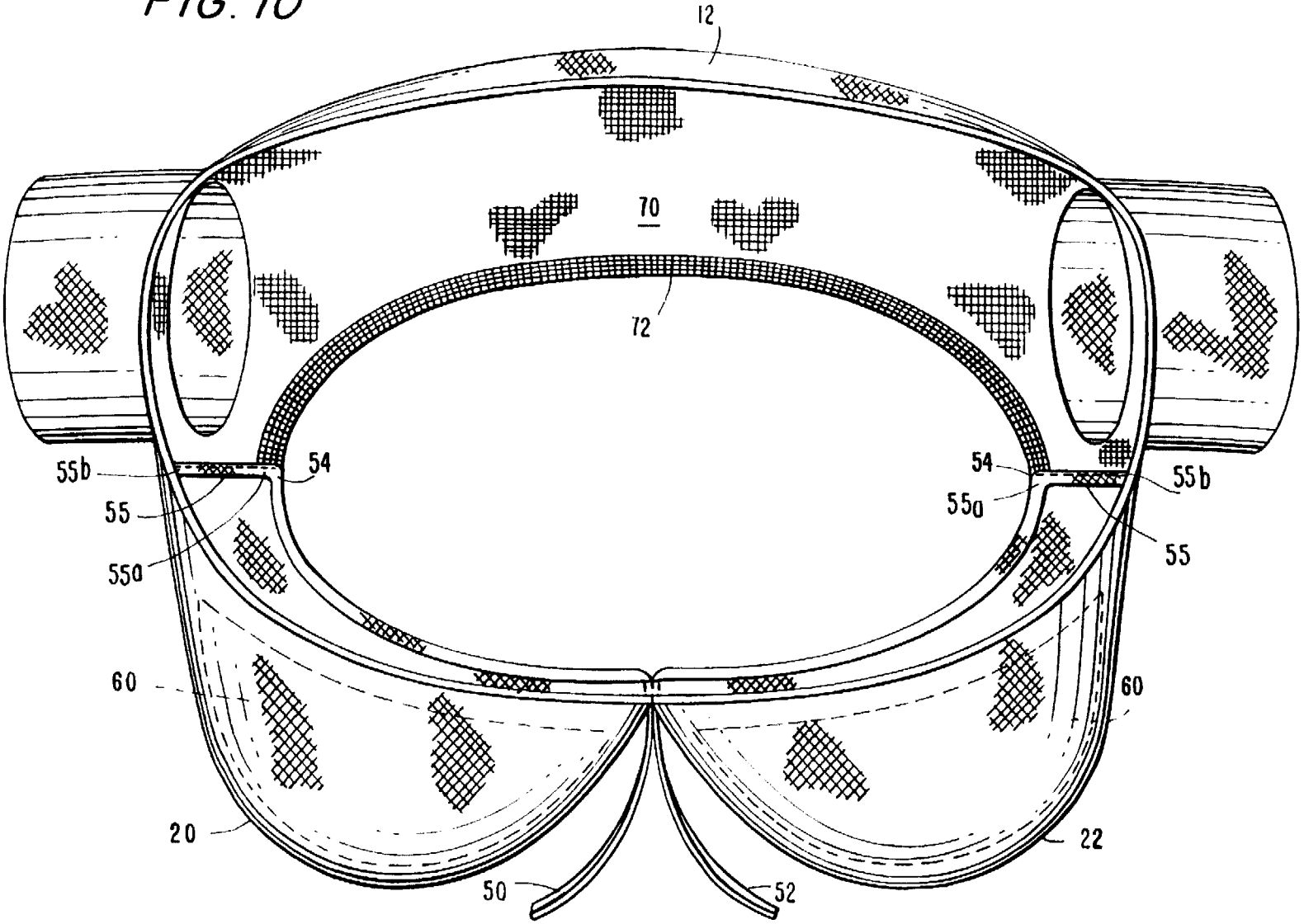
FIG. 10 is a top, perspective, broken-away view of the interior of a third embodiment of a nightgown according to this invention.

Referring now to FIGS. 1–6, reference numeral 10 generally identifies a garment, especially apparel intended for wear by women, but equally well adapted to be worn by men, particularly female impersonators. The term "garment" is intended to cover clothing worn on a wearer's torso, such as dresses, blouses, bras, slips, frocks, leisure suits, sleepwear and nightgowns, for any purpose, including athletic events, and at any time, including both day and night use.

As shown in FIG. 1, the garment 10 is a nightgown. This was done for ease of illustration because, as noted above, this invention is not intended to be limited to only such sleepwear. The nightgown 10 has a rear garment portion 12 generally overlying at least part of a wearer's back when worn and, in the illustrated case, extending from shoulder straps 14 downwardly of the body past the wearer's knees, as well as a front garment portion 16 generally overlying at least part of the wearer's chest when worn and, as illustrated, extending downwardly of the body past the wearer's knees. The front and rear garment portions 16, 12 are connected together, preferably by sewing, along side seams 18 (only one illustrated in FIG. 1).

The front garment portion 16 has two chest panels 20, 22 at both sides of the wearer. The chest panels are held together by buttons 24 or an analogous closure. As described so far, the gown 10 is conventional.

In accordance with this invention, as best seen in FIG. 5, a pair of backings 30, 32 underlie the chest panels 20, 22. As shown in FIG. 2 for representative backing 30, each backing has an upper region 24 connected to the chest panels at stitching 26 at an elevation above the wearer's breasts, and a lower region 28 located below the wearer's breasts.

As also seen in FIG. 5, a pair of liners 40, 42 are situated between the chest panels 20, 22 and the backings 30, 32. Each liner has upper regions 34 connected to the chest panels and the upper region 24 of the backings at stitching 26, as well as lower regions 38 overlying the lower regions 28 of the backings.

The lower region 28 of each backing is stitched along a pair of spaced-apart seams 44, 46 to the lower region 38 of each liner, thereby forming a pair of elongated channels 48 in which a pair of drawstrings 50, 52 are slidably accommodated. The channels 48 extend generally horizontally along the midriff of the wearer.

Each drawstring has one anchored end, for example, see anchored end 54 in FIG. 6 for representative drawstring 52, connected, typically by being sewn, to the side seam 18. Each drawstring has an opposite accessible end 56 accessibly located adjacent the front garment portion 16 and its respective channel 48. FIG. 1 depicts the drawstrings loosely hanging down exteriorly of the front of the garment, while FIG. 3 depicts the drawstrings tied together in a bow knot 58 for a purpose explained in detail below. The accessible ends 56 could also be located interiorly of the front garment portion.

Reference numeral 60 identifies a breast prosthesis to be used as a substitute for a natural breast removed as a result of a mastectomy. As shown in FIG. 2, the backing 30 and the liner 40 together form a pocket 62 into which the prosthesis 60 is inserted in the manner illustrated in FIG. 6 where the prosthesis 60 is inserted from the side between the backing and the liner. The backing and the liner are peripherally stitched together to form a pocket that is closed along its entire periphery, except at the unstitched side opening 64' through which the prosthesis is inserted. The prosthesis itself is a commercially available product constituted of a silicone, foam or fiber fill material, each designed to simulate the size, color, texture and density of the removed natural breast. In practice, the prosthesis is the same weight or lighter than the removed natural breast.

As shown in FIG. 5, only one prosthesis 60 is shown in the pocket formed on the left side of that figure. The right side of that figure depicts a natural breast 64 lying against the backing 32 which, in turn, lies in surface contact with the liner 42 and the chest panel 22. This depicts the situation where only one natural breast has been removed. In the event that the natural breast 64 was also removed, then a second prosthesis would be inserted into the pocket bounded by the backing 32 and the liner 42. The backing 32 at the right side of FIG. 5 forms a pocket or cup that receives the natural breast 64.

Once the wearer dons the garment 10 in FIG. 1, the wearer pulls on either one, or preferably both, of the drawstrings 50, 52, thereby moving the lower regions 28, 38 of each backing and each liner, as well as each lower channel 48, from the initial position shown in FIG. 2 wherein these lower regions are spaced from the wearer's body, to a final position shown in FIG. 4 wherein these lower regions are drawn tightly against the wearer's body and effectively secure each pocket, as well as the breast, either the prosthesis 60 or the natural breast 64, in place.

Each drawstring is pulled taut before being tied into the knot 58. The tension on each drawstring is selected for comfort by the wearer. Thus, the tension on each drawstring is independently adjustable, and can be different for each drawstring—a situation desired where a different tension on drawstring 50 is needed to secure the prosthesis 60 in FIG. 5 as compared to the tension on drawstring 52 that is needed to secure the natural breast 64. In either case, by tightly holding the lower regions 28, 38 against the wearer's body, the prosthesis 60 or natural breast 64 is restrained from conducting uncontrollable swaying movements.

Everything discussed above for the natural breast 64 applies equally to the situation where a breast implant, either saline or silicone, is placed within the wearer's chest. The term "breast" as recited in the claims is intended to cover a breast prosthesis, a natural breast, or a breast implant. Thus, an implant, especially a large-sized one, requires the same restraining action as a large-sized natural breast. In addition, the elevation or height of the implant can change over the course of time. In such event, the independently adjustable drawstring and pockets tend to compensate for such different heights.

Turning now to the second embodiment depicted in FIGS. 7–9, the essential difference with the first embodiment of FIGS. 1–6 lies in the elimination of the liners 40, 42. The same reference numerals have been used to identify like elements. Thus, the pocket 62 is not formed between a backing and a liner, but between the backing 30, 32 and the chest panel 20, 22 by stitching the lower region 28 of each backing directly to the chest panels 20, 22 below the received breast along seams 44 and 46. This results in a more form-fitting, high-waisted garment.

In either disclosed emboidment, as best seen in FIGS. 3 and 7, except for the presence of the bow knot, which can be dismissed as a decorative accessory, the restraining structure is effectively concealed from exterior view. For a wearer having had a mastectomy, the wearing of a nightgown 10, as shown in FIGS. 3 and 7, without any tell-tale signs that one or more prostheses are being worn not only provides physical comfort, but perhaps even more importantly, provides psychological relief.

The garment portions 12, 16 are constituted of any sheet fabric material. In the case of a nightgown where a lightweight, thin material is desired, the use of silk, cotton, polyester and like fabrics is preferred. The fabric may be woven, unwoven or knitted. The fabric can even be made of a stretch material, like elastic yarns. The backings and/or the liners can be made of the same or a different material as the garment portions. Thus, a gauze or open network mesh can be used for the backings and/or liners.

The drawstrings can be constituted of the same or a different material from the garment portions. Typically, the drawstrings are made of flat, ribbon material, but cords of circular cross-section could be employed.

The drawstrings need not be tied to each other, but could be tied or secured to one or more anchoring points outside or inside of the garment. When tied to each other, a different knot can be used, or the drawstrings can be wrapped around the wearer and tied behind her back, or tied at either side of the wearer's waist. The drawstrings, upon exiting their respective channels, can pass through a common central hole or slit in the front garment portion, or through individual holes in the front garment portion. The holes or eyelets can be reinforced for extra strength.

As described so far, the anchored end of each drawstring that is interior to the garment is sewn to each side seam 18, but can equally well be secured to any convenient place on the front and rear garment portions, or to the backing and/or liner. As shown in FIG. 10, a rear mesh panel 70 is stitched along its top edge to the top edge at the interior surface of the rear garment portion 12. An elastomeric stretch band 72 extends along the lower region of the rear mesh panel 70 at the same elevation as the lower regions 28 of the backings 30, 32. The anchored ends 54 of the drawstrings 50, 52 are stitched directly to the opposite ends of the stretch band 72, and also along side edges 55 from a lower junction **55*a* to a top edge 55*b*. Alternatively, the ends of the band 72 are connected directly to the backings. In either event, when the drawstrings are pulled taut, the lower junctions 55*a* are drawn toward each other to a greater extent than the top edges 55*b*, thereby creating an "underwire" for supporting the breasts from below and for pushing the breasts together from the side edges 55 inwardly. The stretch band 72 is concomitantly stretched, and the rear mesh panel 70 provides an extra measure of support for holding up the prostheses 60, natural breasts 64**, or implants.

The garment disclosed herein can be employed by smaller-breasted women, but will not have the same degree of utility. No matter whether an implant, natural breast or prosthesis is present for one or both breasts, the tension produced by the taut drawstrings effectively restrains the implant, breast, or prosthesis in place—all without any external, readily visible means of support.

It will be understood that each of the elements described above, or two or more together, also may find a useful application in other types of constructions differing from the types described above.

While the invention has been illustrated and described as embodied in women's apparel, especially mastectomy nightgowns, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

1. A garment, comprising:

a) a rear garment portion generally overlying at least part of a wearer's back when worn;

b) a front garment portion connected to the rear garment portion and generally overlying at least part of a wearer's chest when worn;

c) a backing underlying the front garment portion at one side of the wearer's chest and bounding a pocket for receiving an artificial breast, said backing having an upper region connected to the front garment portion above the received breast, and a lower region situated below the received breast; and d) an elongated drawstring extending at least partly along the lower region and terminating in an accessible end region accessibly located relative to the front garment portion and operative, when pulled and held, to secure the pocket and the received breast in place on the wearer's chest.

2. The garment according to claim 1, wherein each garment portion is constituted of a fabric sheet material.

3. The garment according to claim 1, wherein the upper region of the backing is sewn to, and suspended from, the front garment portion; and wherein the lower region of the backing is sewn to, and forms an elongated channel with, the front garment portion; and wherein the drawstring extends at least partly lengthwise along the channel.

4. The garment according to claim 3, wherein the drawstring has an anchored end region connected to the rear garment portion and an intermediate portion located between said end regions and slidably mounted in the channel.

5. The garment according to claim 1; and further comprising a liner intermediate the front garment portion and the backing, and wherein the liner and the backing together bound the pocket for receiving the breast, said liner having an upper region connected to the front garment portion above the received breast, and a lower region situated below the received breast.

6. The garment according to claim 5, wherein the upper regions of the backing and the liner are sewn to, and suspended from, the front garment portion; and wherein the lower regions of the backing and the liner are sewn to, and form an elongated channel with, each other; and wherein the drawstring extends at least partly lengthwise along the channel.

7. The garment according to claim 1, wherein the backing forms with the front garment portion a side opening through which a breast prosthesis passes into the pocket.

8. The garment according to claim 5, wherein the backing and the liner form a side opening through which the breast prosthesis passes into the pocket.

9. The garment according to claim 1; and further comprising another backing underlying the front garment portion at another side of the wearer's chest and bounding another pocket for receiving another artificial breast, said other backing member having an upper region connected to the front garment portion above the other received breast, and a lower region situated below the other received breast; and also comprising another elongated drawstring extending at least partly along the lower region of the other backing and terminating in another accessible end region located exteriorly of the front garment portion and operative, when pulled and tied to the first-mentioned drawstring, to secure the other pocket and the other received breast in place on the wearer's chest.

10. The garment according to claim 9, wherein the front garment portion has a central opening through which both drawstrings pass; and wherein both accessible end portions are tied into a knot situated outside of the central opening.

11. A woman's garment, comprising:

a) a rear garment portion constituted of a fabric material and generally overlying at least part of a woman's back when worn;

b) a front garment portion constituted of a fabric material, sewn to the rear garment portion, and generally overlying at least part of a woman's chest when worn;

c) a pair of backings constituted of fabric material, underlying the front garment portion at opposite sides of the woman's chest, and forming a pair of pockets for receiving a pair of breasts, said backings having upper regions connected to the front garment portion above the received breasts, and lower regions situated below the received breasts; and d) a pair of drawstrings extending at least partly along the lower regions and terminating in accessible end regions accessibly located adjacent the front garment portion and operative, when pulled and tied together into a knot, to secure the pockets and the received breasts in place on the woman's chest.

12. The garment according to claim 11, wherein the upper regions of the backings are sewn to, and suspended from, the front garment portion; and wherein the lower regions of the backings are sewn to, and form a pair of elongated channels with, the front garment portion; and wherein the drawstrings extend at least partly lengthwise along, and are independently slidably mounted in, the channels.

13. The garment according to claim 11; and further comprising a pair of liners intermediate the front garment portion and the backings, and wherein a liner and a backing of each pair form a respective pocket, and wherein the liners have upper regions connected to the front garment portion above the received breasts, and lower regions situated below the received breasts.

14. The garment according to claim 13, wherein the upper regions of the backings and the liners are sewn to, and suspended from, the front garment portion; and wherein the lower regions of the backings and the liners are sewn to, and form a pair of elongated channels with, the front garment portion; and wherein the drawstrings extend at least partly lengthwise along, and are independently slidably mounted in, the channels.

15. The garment according to claim 11; wherein the backings form with the front garment portion a pair of side openings through which said breasts, which are prostheses, pass into the pockets.

16. The garment according to claim 15, wherein the backings form with the liners a pair of side openings through which the breasts prostheses pass into the pockets.

17. The garment according to claim 11, wherein the front garment portion has a central opening through which both drawstrings pass, and wherein the knot tied by both drawstrings is situated outside of the central opening.

18. A mastectomy nightgown, comprising:

a) a rear gown portion constituted of a relatively thin fabric sheet material that generally overlies at least part of a woman's back when worn;

b) a front gown portion constituted of a relatively thin fabric sheet material that generally overlies at least part of a woman's chest when worn;

c) a backing constituted of a relatively thin fabric sheet material, underlying the front garment portion at one side of the woman's chest, and bounding a pocket for receiving an artificial breast, said backing having an upper region connected to the front gown portion above the artificial breast received in the pocket, and a lower region having a channel situated below the artificial breast; and d) an elongated drawstring having a drawstring portion extending along the channel and terminating in an accessible end region located adjacent the front gown portion and operative, when pulled and held, to secure the pocket and the artificial breast in place on the woman's chest, said drawstring portion within the channel being concealed from external view of the nightgown.

19. The nightgown according to claim 18, wherein the drawstring has an anchored end portion connected to the rear gown portion.

20. The nightgown according to claim 18; and further comprising a stretch band extending along the rear gown portion; and wherein the drawstring has an anchored end portion connected to the stretch band.

* * * * *